US009410494B2

(12) United States Patent
Michel

(10) Patent No.: US 9,410,494 B2
(45) Date of Patent: Aug. 9, 2016

(54) METHOD OF ASSESSING THE FUNCTIONING OF AN EGR COOLER IN AN INTERNAL COMBUSTION ENGINE

(71) Applicant: DELPHI TECHNOLOGIES HOLDING, S.arl, Bascharage (LU)

(72) Inventor: Eric L. P. Michel, Arlon (BE)

(73) Assignee: Delphi International Operations Luxembourg SARL., Luxembourg (LU)

( * ) Notice: Subject to any disclaimer, the term of this patent is extended or adjusted under 35 U.S.C. 154(b) by 899 days.

(21) Appl. No.: 13/677,449

(22) Filed: Nov. 15, 2012

(65) Prior Publication Data

US 2013/0124070 A1 May 16, 2013

(30) Foreign Application Priority Data

Nov. 16, 2011 (EP) ..... 11189279

(51) Int. Cl.

| | |
|---|---|
| ***F02M 25/00*** | (2006.01) |
| ***F02D 41/00*** | (2006.01) |
| ***F02D 41/34*** | (2006.01) |
| ***F02D 35/02*** | (2006.01) |

(52) U.S. Cl.

CPC ..... *F02D 41/0065* (2013.01); *F02D 35/028* (2013.01); *F02D 41/345* (2013.01); *F01P 2060/10* (2013.01); *F02D 2041/0067* (2013.01)

(58) Field of Classification Search

CPC ..... F02M 25/0702; F02M 25/0726; F02M 25/0707; F02M 25/0737; F02M 25/0734; F02M 26/22; F02M 26/49

USPC ..... 123/435, 568.12, 568.16

See application file for complete search history.

(56) References Cited

U.S. PATENT DOCUMENTS

| | | | | |
|---|---|---|---|---|
| 5,617,833 | A | 4/1997 | Tomisawa et al. | |
| 5,632,257 | A | 5/1997 | Machida et al. | |
| 2008/0264382 | A1 | 10/2008 | Kang | |
| 2011/0224948 | A1 | 9/2011 | Cianflone et al. | |
| 2012/0290190 | A1 * | 11/2012 | Kim | F02M 25/0702 701/102 |

FOREIGN PATENT DOCUMENTS

| | | |
|---|---|---|
| GB | 2473602 | 3/2011 |
| JP | 2010-106734 | 5/2010 |

OTHER PUBLICATIONS

European Search Report dated Jun. 29, 2012.

* cited by examiner

*Primary Examiner* — Thomas Moulis
(74) *Attorney, Agent, or Firm* — Joshua M. Gaines

(57) ABSTRACT

A method of assessing the functioning of an EGR cooler of an EGR system in an internal combustion engine, wherein the EGR cooler can be selectively operated in a first and a second operating condition; and wherein the engine comprises at least one cylinder equipped with a pressure sensor. The assessment of the functioning of the EGR cooler is based on the variation of a combustion characteristic value depending on cylinder pressure (CA50), upon switching of the EGR cooler from a first to a second operating condition.

20 Claims, 2 Drawing Sheets

METHOD OF ASSESSING THE FUNCTIONING OF AN EGR COOLER IN AN INTERNAL COMBUSTION ENGINE

FIELD OF THE INVENTION

The present invention generally relates to internal combustion engines provided with an exhaust gas recirculation system with control valve and an associated cooler.

BACKGROUND OF THE INVENTION

Exhaust gas recirculation (EGR) systems are now commonly found in internal combustion engines. As it is well known, EGR systems can be utilized to control the cylinder charge and therefore the combustion process. The exhaust gas recirculated to the intake manifold (the amount of which can be regulated via an EGR valve) increases the proportion of inert gas in the fresh gas filling. This results in a reduction in the peak combustion temperature and, in turn, in a drop in temperature-dependent untreated NOx emissions.

It is desirable to be able to check the functioning of an EGR system. U.S. Pat. No. 5,632,257 relates to a method of diagnosing an EGR valve, wherein the EGR valve is forcibly operated in open/closed positions. An estimation of whether or not the actual exhaust gas recirculation quantity has changed with the forcible operation of the EGR valve is then made based on the corresponding variation in combustion pressure. This variation in combustion pressure is monitored as a change in IMEP.

In some engines, the EGR system comprises an EGR cooler that allows cooling the exhaust gas traveling to the intake manifold. The EGR cooler typically comprises a bypass valve that allows bypassing the EGR cooler (i.e. there is no flow of exhaust gas through the cooling part) so that, in effect, the bypass valve operates as an on/off valve for the cooler.

A difficulty that however arises with such EGR coolers is the impossibility of checking the proper functioning thereof. Indeed, contrary to the EGR valve, the bypass valve is normally not provided with a position sensor. Neither is there any temperature sensor at the EGR cooler outlet or in the intake manifold that would permit checking that the EGR gas has been cooled.

GB 2473602 describes a method for the diagnosis of the EGR cooler efficiency in a diesel engine, which employs a model for determining the temperature drop in the EGR cooler and that applies the so-called "Statistical Local Approach". This model is able to correlate the efficiency of the cooler with the gas temperature and pressure values in the exhaust and intake manifold. Hence, temperatures at the EGR cooler inlet and outlet are required, as well as inlet and outlet pressures. This is thus a complex system to perform EGR cooler diagnostic that requires many input variables.

SUMMARY OF THE INVENTION

The present invention arises from the desire of being able to assess the functioning condition of an EGR cooler, despite any dedicated sensor within the EGR cooler.

With this objective in mind, the present inventor has found that the proper operation of an EGR cooler can be assessed by monitoring the variation of a combustion characteristic parameter dependent on the pressure measured in a combustion chamber of the engine, between a first operating condition of the EGR cooler and a second operating condition of the EGR cooler. In other words, the invention proposes observing the change of this pressure-dependent combustion characteristic parameter in two operating modes of the EGR cooler, respectively upon switching of the EGR cooler from one operating condition to the other.

Hence, the present method finds application in internal combustion engines where a pressure sensor is installed in at least one cylinder. In this connection, it shall be noted that some diesel engines are now equipped with pre-heating plugs featuring an in-cylinder pressure sensor. In other words, pressure information is readily available in such engines, whereby, as it will be understood, the present method can be implemented on the basis of conventionally available information and means, and at virtually no additional costs.

A merit of the present invention is thus to have found an indirect way of evaluating or diagnosing the proper or faulty operation of an EGR cooler in an EGR system. Indeed, switching of the EGR operating condition should cause a change of temperature of the recirculated gases and hence affect the temperature of the inducted mixture, and thereby impact the combustion. Hence, an absence of change or a too minor variation of the combustion characteristic value when switching from one EGR cooler condition to the other appears as a malfunction in the EGR cooler.

The required combustion characteristic values are preferably obtained under substantially similar engine operating conditions (say for stable engine speed and load), except for the EGR cooler that is alternately operated between the two operating conditions. Preferably, the two operating conditions of the EGR cooler are enabled (on) and disabled (off). The present diagnostic sequence may be carried out very rapidly, which means that it will be easy in practice to identify a steady-state condition during which the diagnostic can be performed.

In addition, the combustion characteristic parameters should preferably be observed at substantially same EGR rate (different from zero), and preferably substantially similar engine temperature.

In practice, implementation of the method requires determining the combustion characteristic value in both conditions of the EGR cooler. The difference between these values is then preferably compared to a calibrated range or threshold. The calibrated threshold or range may be dependent on EGR rate and engine temperature. There is no particular order for determining the combustion characteristic values, i.e. one can first acquire the combustion characteristic value with the EGR cooler in the first operating condition or in the second.

It may be noted that while it may be sufficient to carry out a single determination of the combustion characteristic value in each operating condition of the EGR cooler, it is preferable to use average values determined during a certain time period for each EGR operating condition, which allows minimising measuring noise.

The present method may thus include a test cycle wherein, in a first cycle portion a first combustion characteristic value (preferably an average value) is determined for one of the first or second EGR operating condition; and in a second cycle portion a second combustion characteristic value (preferably an average value) is determined in the other EGR operating condition. Depending on the implementation of the present method (passive or intrusive—see below), the first and second cycle portions may directly follow one another or be separated by a time interval.

Preferably, the combustion characteristic value is obtained from heat release analysis in a combustion cycle, in particular by considering the heat release and more preferably the net (or apparent) heat release.

In a preferred embodiment, the combustion characteristic parameter is indicative of a given percentage of (total) heat release, preferably the net total heat release, in a combustion cycle, more specifically the timing (given in crank angle units) of this percentage of total heat release. Indeed, the knowledge of the pressure in the combustion chamber and of the combustion chamber volume, over crank angle position, allows monitoring the rate of heat release during the combustion and then any percentage of the total (cumulated) heat release for a given combustion cycle.

The heat release is an indicator of the combustion state and is influenced by the temperature of the inducted gas mass. Virtually, any crank angle corresponding to a given percentage of heat release rate (hereinafter also noted $CA_X$ where X is the given percentage) could be used as the combustion characteristic parameter for the present diagnosis. However, in order to avoid edge effects, a more preferred range is 30 to 70% of heat release (i.e. CA30 to CA70). More preferably, the combustion characteristic parameter is indicative of the crank angle corresponding to a heat release rate in the range of 40 to 60%.

In this connection, it has been found that the crank angle corresponding to 50% of total net heat release, i.e. the crank angle at which 50% of the total combustion energy has been released—commonly referred to as CA50, proves to be particularly sensitive to the temperature of the EGR gases. The CA50 is thus a parameter sensibly affected by the operating condition of the EGR cooler. A comparison between a first CA50 value obtained with the EGR cooler enabled and a second CA50 value obtained with the EGR cooler disabled permits discriminating between a fully operative EGR cooler and an EGR cooler malfunction.

As it is clear for those skilled in the art, a minor variation of the combustion characteristic value, resp. of CA50 or $CA_X$, is an indication that there is probably a fault in the EGR cooler: the bypass valve may be blocked in an open, closed or intermediate position, or the EGR cooler may be clogged . . . .

It should however be noticed that the extent of variation of the combustion characteristic value, resp. of CA50 or $CA_X$, may depend on the EGR rate and engine temperature. Indeed, a comparatively lower amount of EGR has less impact on the inducted gas mixture that a large amount of EGR. Engine temperature has further appeared to be a parameter significantly affecting the combustion characteristic value, resp. CA50 or $CA_X$, in the present method. Accordingly, for optimal performance, the present diagnostic should advantageously be carried out at EGR rates in the order of 30 to 50%, in particular about 40%. The engine temperature should preferably be in the medium range, for example between 20 and 50° C., and preferably about 40° C. Indeed, a stronger cooling effect of EGR cooler is obtained when the engine temperature is low (in particular where EGR cooler operates with engine coolant).

Two approaches are possible to determine the combustion characteristic values in both EGR cooler conditions. A first "passive" possibility is that the control unit in charge of performing the present diagnostic waits until both situations occur "naturally" (as operated by other engine control schemes), with the desired constraints in EGR rate and engine temperature. Alternatively, in stable driving conditions, the control unit may force the present diagnostic scheme by controlling the EGR valve at the desired EGR rate and switching on and off the EGR cooler, as required in order to acquire the desired combustion characteristic values in both EGR cooler operating conditions.

It may be noted that in the past, the IMEP (indicated mean effective pressure) has been proposed as a parameter to monitor combustion changes due to forcible operation of an EGR valve (not EGR cooler), as disclosed in U.S. Pat. No. 5,632,257. The method disclosed therein requires stopping the flow of recirculated gas by closing the EGR valve, and would therefore not be applicable to check the influence of the cooling on the recirculated gases, which requires the presence of recirculated gases. Furthermore, the IMEP is not considered to be appropriate for reliably monitoring a change of temperature of the recirculated gases. By contrast, it has been observed that the temperature change that can be achieved through a functional EGR cooler can be reliably monitored by means of the heat release, and thus by means of CA50 or $CA_X$. Another remark, which is clear to those skilled in the art, is that IMEP and CA50 (or $CA_X$) are very different indicators. IMEP is an indication of torque and reflects the global work produced by the engine. From the heat release however, one can deduce when the combustion starts and the duration thereof, as well as CA50. As the engine is conventionally controlled to meet a desired torque, it is frequent to regulate a constant IMEP, e.g. by adapting the combusted fuel quantity, however leading to various CA50 values.

It may be noted that some engines may comprise a cylinder-pressure based combustion control unit by which the combustion characteristic value is maintained (by means of a closed-loop control) at a given set point by adjusting a fuel injection parameter. In such case, the assessment of the functioning of the EGR cooler may be based on the variation of this fuel injection parameter between the first and the second operating conditions of the EGR cooler. In case the combustion characteristic value is the CA50 or $CA_X$, the fuel injection parameter of concern may be the main injection timing that is typically adjusted to maintain the CA50, resp $CA_X$ set point. Hence, a malfunction of the EGR cooler can be detected on the basis of the extent of variation of the injection timing following a change of condition of the EGR cooler from the first to the second position (or inversely). Again, the difference of the main injection timing values determined in both EGR cooler operating conditions may be compared to a calibrated threshold or range. The calibrated threshold or range may be dependent on EGR rate and engine temperature.

Therefore, according to another aspect of the present invention, a method of assessing the functioning of an EGR cooler of an EGR system in an internal combustion engine is proposed, wherein the EGR cooler can be selectively operated in a first and a second operating condition. The engine comprises at least one cylinder equipped with a pressure sensor and a control unit configured to perform a cylinder-pressure based combustion control by which a combustion characteristic value depending on cylinder pressure is maintained at a given set point by adjusting a fuel injection parameter.

It shall be appreciated that the assessment of the functioning of the EGR cooler is based on the variation of the injection parameter between the first and the second operating conditions of said EGR cooler.

Preferred embodiments of this method may involve one or more of the following features:

- the decision on a malfunction is made on the basis of the difference of the fuel injection parameter between the first and the second situation, this difference being compared to a calibrated range or calibrated threshold;
- the combustion characteristic value is indicative of the timing of a given percentage of net heat release $CA_X$, preferably of the crank angle corresponding to 50% of maximum net heat release (CA50) and the fuel injection parameter is a main injection timing;

injection parameter values in the first and second situations are determined for substantially similar EGR rates and at substantially stable engine conditions;

the values of the fuel injection parameter in the first and second situations are determined for an EGR in the range of 30 to 50%, preferably about 40%;

the injection parameter values in the first and second conditions are determined at cold to moderate engine temperature, preferably no more than 50° C.;

It remains to be noted that in the above-described methods, the cylinder-pressure dependent combustion characteristic value is preferably the CA50 or in the range CA30 to CA70. However, as already indicated, it could by the crank angle of another given ratio of (net) heat release. Other possibilities for the cylinder-pressure dependent combustion characteristic value may for example be: an in-cylinder pressure build-up rate, an in-cylinder peak pressure, a phase (crank angle) of in-cylinder peak pressure, a combustion starting point.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
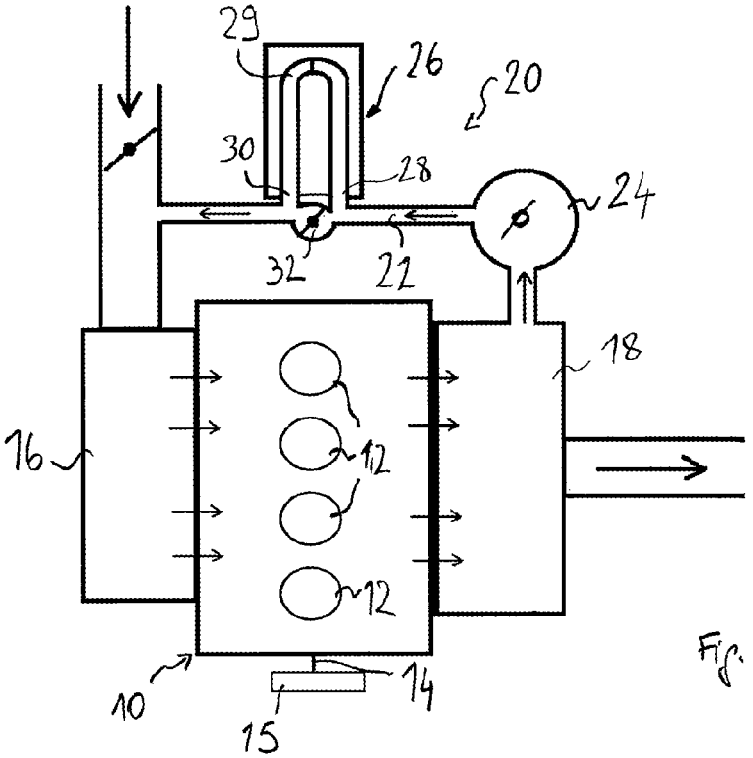
FIG. 1: is a principle diagram of an internal combustion engine with EGR valve and EGR cooler.

As schematically represented in FIG. 1, an internal combustion engine 10 includes an engine block with a plurality of cylinders 12, illustrated in exemplary fashion as a 4-cylinder engine. The basic arrangement of engine 10 is known in the art and will not be repeated exhaustively herein in detail. However, it should be understood that each cylinder 12 is equipped with a corresponding piston (not shown), which is connected to a common crankshaft 14. As it is known, the crankshaft 14 is coupled to a powertrain (e.g., transmission and other drivetrain components—not shown) in order to provide power to a vehicle (not shown) for movement. Controlled firing of the cylinders causes the various pistons to reciprocate in their respective cylinders, causing the crankshaft 14 to rotate.

There is a known relationship between the angular position of the crankshaft 14 and each of the pistons. Each piston, as it reciprocates, moves through various positions in its cylinder, and any particular position is typically expressed as a crankshaft angle with respect to top-dead-center position. In this connection, reference sign 15 indicates an encoder for determining the angular position of the crankshaft. The encoder 15 may be a so-called target wheel that cooperates with a sensor. The target wheel is rotationally coupled with the crankshaft and includes a plurality of radially-outwardly projecting teeth separated by intervening slots, as well as one synchronization gap defined by missing teeth. The target wheel 18 and associated sensor are, in combination, configured to provide an output signal that is indicative of the angular position of the crankshaft, as it is well known in the art.

Fresh air for the combustion is supplied to the cylinders 12 via an intake manifold 16 and combustion or exhaust gases are collected in an exhaust manifold 18. An exhaust gas recirculation system 20 is interposed between the exhaust 18 and the fresh air intake 16. The EGR system 20 includes a recirculation passageway 22 linking the exhaust 18 to the intake manifold 18, in which an EGR valve 24 is installed. The EGR valve 24 is operable to control the amount of exhaust/combustion gas (exhausted by the engine cylinders) that is allowed to flow to the intake side 16 via the passageway 22. In some embodiments, the EGR valve 24 can be a simple on-off valve, while in more prevalent and preferred designs, the valve 24 is a variable position valve that can be modulated between a fully opened and a fully closed position.

In the illustrated embodiment, exhaust gases from the engine flow through passageway 22 and EGR valve 20 to an EGR cooler 26. The EGR cooler 26 operates to cool the exhaust gas within the EGR system 20 for reentry through a downstream section of recirculation passageway 22 into the fresh air intake manifold 14 of the engine 10. As is known, cooling the exhaust gas being re-circulated reduces overheating of the air/fuel mixture flowing into the engine, reduces fuel evaporation and yields better engine operating efficiency. In one type of EGR cooler 26, the gas flowing through the EGR system 26 passes over a radiator-type construction in which a cooling fluid or coolant (e.g. engine coolant water) flows through the radiator element. In the illustrated embodiment, re-circulated gases enter the EGR cooler 26 at inlet 28, pass through a cooling part 29 where heat is transferred to a cooling medium (e.g. engine coolant) and exit at outlet 30.

Preferably, the EGR cooler 26 includes a bypass valve 32 that allows direct connection of the EGR cooler inlet 28 to outlet 30. Accordingly, the bypass valve 32 is selectively operable between a first operating condition (closed/disabled) and a second operating condition (open/enabled). Hence, when the bypass valve 32 is closed, the exhaust gas flows through the EGR cooler 26, whereas when bypass valve 32 is open, the exhaust gases flow directly to the outlet 30, without passing through the cooling part 29. In other words, bypass valve 32 acts as an on-off valve for the EGR cooler 26.

Conventionally, the operation of engine 10 is controlled by a programmed, electronic engine control unit (ECU) or the like (not shown), as is known in the art. The ECU is configured generally to receive a plurality of input signals representing various operating parameters associated with engine 10. ECU is further typically configured with various control strategies for producing needed output signals, such as fuel delivery control signals (for fuel injectors—not shown) all in order to control the combustion events. In particular, the ECU determines the fuel quantity to be injected depending on the driver's torque demand.

As it pertains most particularly to the present invention, the ECU provides control signals to the EGR valve 24 and EGR cooler bypass valve 32. Algorithms within the ECU receive signals from various engine and condition sensors. These sensors can provide signals indicative of engine coolant temperature, oil pressure, intake manifold pressure, ambient pressure, and the like. These algorithms then determine when and to what degree the EGR valve 17 is opened to re-circulate exhaust gas emitted by the engine 10. Algorithms also determine when the EGR cooler 26 is to be enabled or disabled, by manipulation of bypass valve 32.

Referring now more specifically to the present invention, a method is provided for diagnosing malfunctions, faults or failures of the EGR cooler 26. To that end, the ECU includes an onboard diagnostic algorithm unit, which is preferably a software-based module that performs the present method in order to determine when an EGR cooler malfunction exists. The present diagnostic method is based on the monitoring of a combustion characteristic parameter depending on the in-cylinder pressure and involves comparing two values of the combustion characteristic parameter, a first value of the combustion characteristic parameter being determined with the EGR cooler enabled and a second value of the combustion characteristic parameter being determined with the EGR cooler disabled.

Individual pressure sensors can be purposively mounted in an engine to enable performance of the present method. However some engines may already be fitted with such sensor, as is e.g. the case for certain diesel engines comprising preheating plugs featuring an in-cylinder pressure sensor. Hence the pressure information may be readily available in the engine.

For the purpose of the present exemplary description, the combustion characteristic parameter used for the EGR cooler diagnostic is the CA50, i.e. the value of crank angle corresponding to 50% of net heat release, which is a well known and commonly used combustion indicator.

Figure 3:
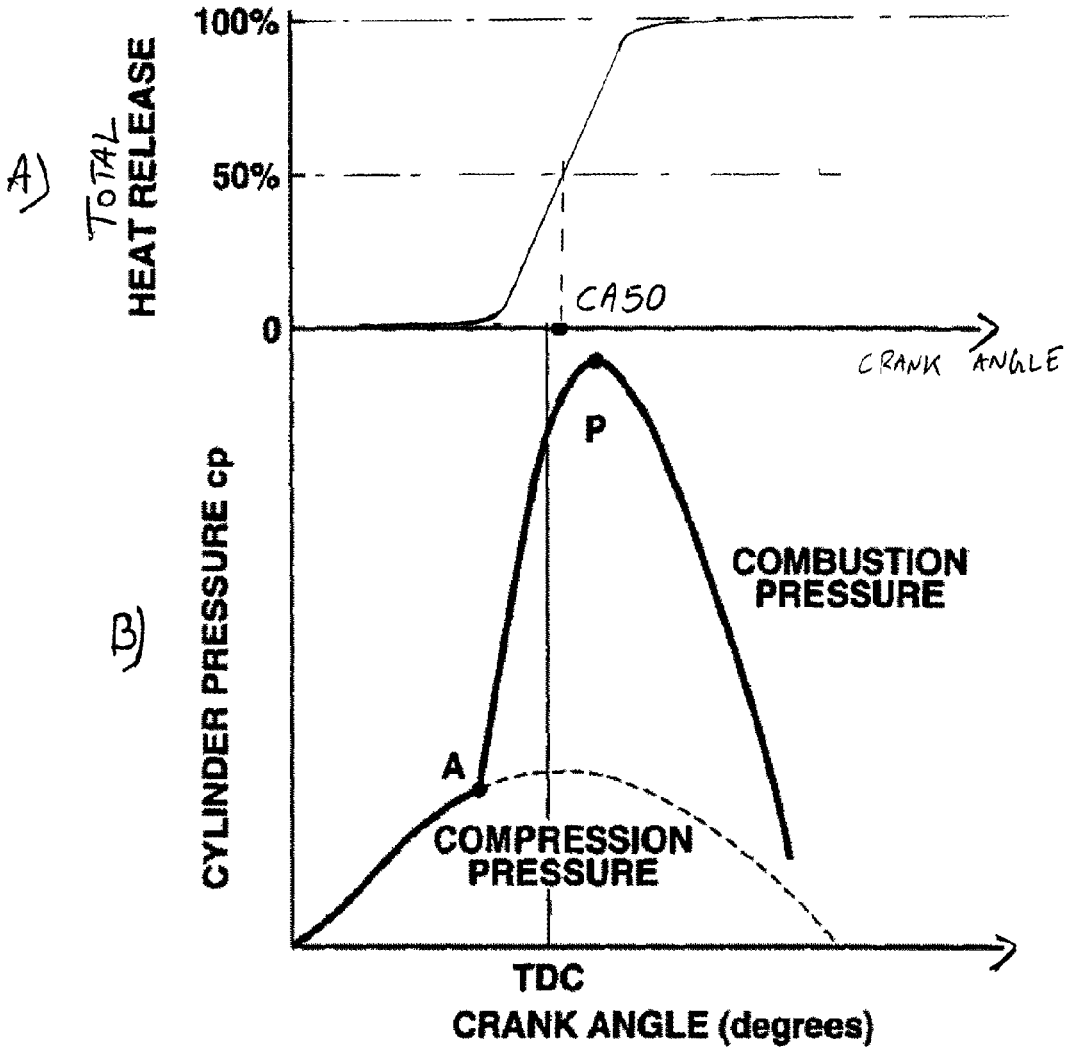
FIG. 3A: is a characteristic diagram illustrating the relationship between the crank angle and the total (cumulated) heat release.
FIG. 3B: is a characteristic diagram illustrating the relationship between the crank angle and the cylinder pressure.

Referring to FIG. 3B, a typical trace of cylinder pressure (cp) vs. crank angle is shown, as may be detected by an in-cylinder pressure sensor. As can be seen, under a condition where no combustion occurs, detected/measured cylinder pressure cp continues to rise due to the air-fuel mixture compressed in the cylinder, until the piston reaches the piston Top Dead Center (TDC) position. After piston 3 passes TDC, the air-fuel mixture begins to expand (phantom line). Cylinder pressure cp is maximum at TDC under the condition where any combustion does not occur. On the contrary, when the air-fuel mixture is burned, as can be seen from the combustion pressure characteristic indicated by the solid line in FIG. 3B, the air-fuel mixture ignites at the point "A" to initiate combustion, and then cylinder pressure cp begins to rapidly rise from the point "A". Thus, the piston works by the increasing cylinder pressure cp. After TDC, cylinder pressure cp tends to gradually fall.

The integrated value of the difference between combustion pressure and compression pressure during one engine operating cycle corresponds to the engine work.

The total, cumulated net heat release is shown in FIG. 3A and is typically considered as an estimation of the state of combustion. As it is well known in the art, the heat release rate and total heat release (total energy released by the combustion) can be arithmetically calculated based on cylinder pressure cp.

Although the concepts of CA50 (or CAx), heat release rate and total heat release are well known in the art, we shall recall some basics about those concepts.

Engine "heat release" is an analyze method based on the first law of thermodynamics and defines the rate at which the chemical energy in the fuel is released in the combustion process. It can be defined in terms of time, which for a combustion engine also means in terms of crank angle. Conventionally, the heat release is calculated from the cylinder pressure, using a single zone model. One may distinguish between:

- "gross" heat release that corresponds to the heat released by the combustion process but is also affected by other heat consuming processes (heat transfer, fuel vaporization, and blowby); and
- "net" or "apparent" heat release, which corresponds to the remaining, available heat for work in the form of pressure. This net heat release is preferably employed in the present method.

A usual formula that can be employed for the calculation of the net heat release rate at the current crank angle is:

$$\frac{dQ}{d\vartheta} = \frac{1}{\gamma - 1} V \frac{dP}{d\vartheta} + \frac{\gamma}{\gamma - 1} P \frac{dV}{d\vartheta}$$

where $\gamma$ is the specific heat ratio of the cylinder mixture;
V is the volume of cylinder at current crank angle;
P is the in-cylinder pressure at current crank angle; and
$\theta$ is the current crank angle.

The cumulated heat release is then the sum of the incremental released heat amounts at each crank angle. From the heat release, the CA50 is calculated. The CA50 is defined as the crank angle where the sum of heat release rate equals 50% of the heat released during the cycle (i.e. total/cumulated heat release). Similarly, one can define $CA_X$ as the crank angle where the sum of heat release rate equals X % of the total heat release.

Figure 2:
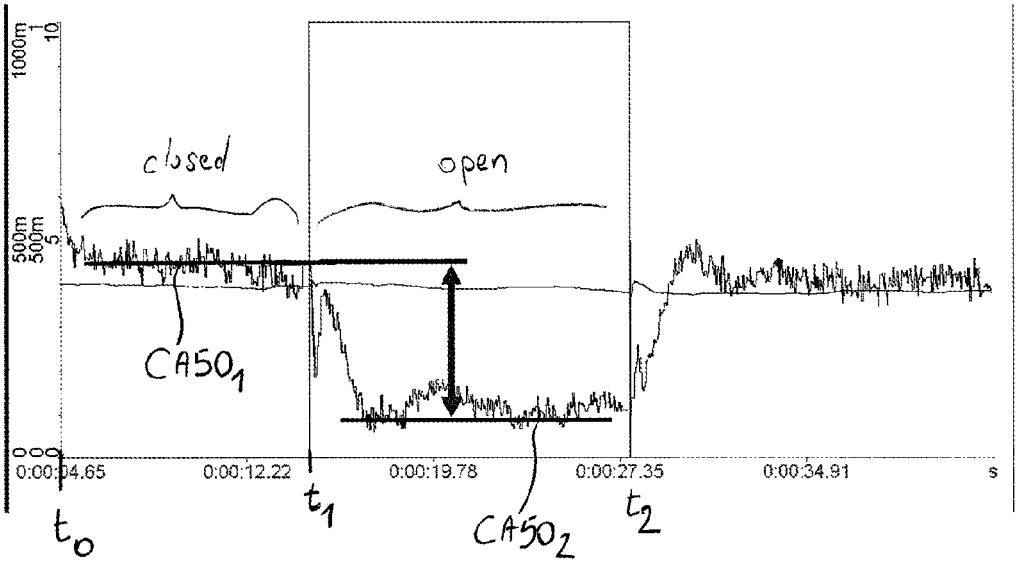
FIG. 2: is a graph showing the variation of CA50 vs. time during a diagnostic interval.

Turning now to FIG. 2, the graph shows the CA50 vs. time. This graph has been obtained under performance of the present diagnostic method for a stable engine condition, i.e. with substantially constant engine speed and load. Initially the bypass valve 32 was closed, but it was opened for a short period from time t1 to t2. As can be seen, before time t1 CA50 is at a value $CA50_1$, hence corresponding to the situation where the bypass valve is closed, i.e. the EGR cooler 26 is enabled and the recirculated gas flows therethrough. At time t1, the bypass valve 26 is opened to bypass the EGR cooler 26, thus brining the EGR cooler 26 in a disabled condition. As a result, hotter gases arrive at the intake manifold and the CA50 drops to a value $CA50_2$ and remains at a low value up to time t2, where the bypass valve 32 is operated back in the enabled condition.

The variation of the CA50 is an indication that the operation of the bypass valve has an effect of the EGR gas flowing back to the intake manifold. In the case of FIG. 2, manipulation of the bypass valve appears to affect the temperature of the recirculated exhaust gas, since switching thereof causes a change in the combustion condition, as reflected by the change in the CA50 value.

Of course, for optimal performance, the determination of the CA50 value in both situations, i.e. alternately with the EGR cooler enabled and disabled, should advantageously be made under substantially similar conditions, typically in a stable engine condition (steady state—same engine speed and load), and particularly at substantially similar EGR rates and engine temperatures.

In practice, the difference between CA50 with EGR cooler enable and disabled may be compared to a calibrated threshold or calibrated range. Hence the ECU may contain a mapping of calibrated threshold values or calibrated ranges in function of EGR rate and engine temperature. The more detailed the calibration efforts, the better the performance of the method.

If it is determined that the difference between $CA50_1$ and $CA50_2$ meets the calibrated threshold or range (e.g. the difference is higher than the calibrated threshold or lies in a given range), then it is concluded that the EGR cooler functioning is correct. In contrast, if the calibrated threshold or range is not met, then it is concluded that a malfunction is present. It may be appreciated that this diagnostic scheme permits detecting situations where the bypass valve 32 may be blocked in an open, closed or intermediate position, or the EGR cooler may be clogged.

It may be noticed that the extent of variation of the CA50 between the EGR cooler enabled and disabled may vary depending on the EGR rate and engine temperature. For optimum performance, the combustion characteristic values (here CA50) are preferably determined at an EGR rate in between 30-50%, in particular about 40%. Also, the engine temperature is preferably in the medium range, say from 20° to 50° C., and in particular about 40° C.

It remains to be noted that while from the theoretic point of view, one value of CA50 is sufficient in each operating condition of the EGR cooler, it is preferable that the compared values of CA50 correspond to average CA50 values determined during a certain period of time in each condition in order to reduce measuring noise. As illustrated in FIG. 2, $CA50_1$ is preferably an average CA50 value during time period t0-t1, whereas $CA50_2$ is preferably an average CA50 value during interval t1-t2. Hence, the diagnostic method may comprise a test cycle where an average CA50 value is determined during a first time period in one EGR cooling condition and a second average CA50 is determined during a second time period in the other EGR cooling condition. A preferred time interval for each cycle portion (t0-t1; t1-t2) is at least 5 s.

In the example of FIG. 2, the diagnostic scheme is intrusive. In such case, the ECU is configured to give predominance to the present diagnostic scheme, which will force the performance of diagnostic cycle. This may typically be the case when the engine is running at steady state (constant engine speed & load) and the engine temperature is in the above-prescribed range. Then the EGR rate is also set (if required) to the prescribed value or ranged, and the bypass valve of the EGR cooler is manipulated as required in order to determine a first value of CA50, i.e. $CA50_1$ with the bypass valve closed, and a second value $CA50_2$ with the bypass valve open.

Conversely, a passive approach can be followed, where the required CA50 values are acquired when the ECU, following its normal operating schemes, causes the engine to operate under the required conditions of EGR rate and engine temperature, and actuating the EGR cooler.

It remains to be noted that another possible implementation of the present diagnostic method may rely, not on the direct calculation of CA50 value, but on the observation of a parameter that reflects a change in CA50.

In this connection, some engines are configured so that the ECU performs a cylinder-pressure based closed-loop combustion control. In particular, engines have been developed where a closed-loop CA50 combustion control is operated. In such engines, a cycle-to-cycle control is performed so that the CA50 remains at a given set point. Therefore, the CA50 is determined every cycle, preferably for each individual cylinder; and PID controllers adjust the injection timing in the next cycle to achieve the desired CA50. Optionally, such control may further involve Indicated Effective Mean Pressure (IMEP) closed-loop control operation, whereby IMEP values are also derived from the cylinder pressure measurements for each cycle and a PID controller further adjust the fuel quantity.

In such case, the engine is thus controlled so that the CA50 remains at a given set point. However, if the manipulation of the bypass valve of the EGR cooler does effectively change the temperature of the intake gases, the ECU will have to modify the injection timing to maintain the CA50 set point. Accordingly, a malfunction of the EGR cooler may be detected by monitoring the variation of the main injection timing arising by a switching of the EGR valve from on to off (on inversely).

As for the malfunction assessment directly based on CA50, the differenced between the two values of main injection timing (corresponding respectively to EGR cooler on and off) are determined under substantially similar engine conditions, in particular concerning EGR rates and engine temperature.

It remains to be noted that in the above-described methods, the cylinder-pressure dependent combustion characteristic value is preferably the CA50. However, as already indicated, it could by the crank angle of another given ratio of net heat release. Other possibilities for the cylinder-pressure dependent combustion characteristic value may for example be: an in-cylinder pressure build-up rate, an in-cylinder peak pressure (point P in FIG. 3B), a phase (crank angle) of in-cylinder peak pressure (crank angle of P in FIG. 3B), a combustion starting point (point A in FIG. 3B).

The assessment of the functioning of the EGR cooler may result in the identification of a fault condition. The response of the system to a fault condition may depend on the nature of the fault condition. For example, a diagnostic trouble code (DTC) may be set and/or a malfunction indicator lamp (MIL) may be illuminated. Depending on the nature of the fault condition, control of the engine or exhaust treatment systems may be changed to a failsafe backup mode to preserve drivability and/or to prevent damage to other components.

The invention claimed is:

1. A method of assessing the functioning of an EGR cooler of an EGR system in an internal combustion engine, wherein said EGR cooler can be selectively operated in a first and a second operating condition; and wherein said engine comprises at least one cylinder equipped with a pressure sensor;

wherein the assessment of the functioning of said EGR cooler is based on the variation of a combustion characteristic value depending on cylinder pressure, between the first and the second operating conditions of said EGR cooler, wherein the method includes the step of indicating a fault condition based on the assessment of the functioning of said EGR cooler.

2. The method according to claim 1, wherein the difference between the combustion characteristic values in the first and the second conditions is compared to a calibrated range or calibrated threshold.

3. The method according to claim 1, wherein the combustion characteristic value determined for each EGR cooler operating condition is an average value determined during a respective diagnostic interval of a diagnostic cycle.

4. The method according to claim 1, wherein said combustion characteristic value is indicative of the timing of a predefined percentage of heat release $CA_X$.

5. The method according to claim 4, wherein said combustion characteristic value is indicative of the crank angle corresponding to a percentage of heat release selected between 30 and 70%.

6. The method according to claim 4, wherein said engine comprises a closed-loop combustion control unit configured to regulate the combustion so as to maintain a pre-defined $CA_X$ set point by adapting the main injection timing, and wherein the observation of the variation of said combustion characteristic value is carried out by observing the variation of said main injection timing, with the EGR cooler alternately in the first and second operating conditions.

7. The method according to claim 1, wherein said combustion characteristic values in the first and second conditions are determined for substantially similar EGR rates.

8. The method according to claim 7, wherein said combustion characteristic values in the first and second conditions are determined for an EGR in the range of 30 to 50%, preferably about 40%.

9. The method according to claim 1, wherein said combustion characteristic values in the first and second conditions are determined at cold to moderate engine temperature.

10. The method according to claim 1, wherein one of said first and second operating conditions corresponds to the EGR cooler enabled and the other to the EGR cooler disabled.

11. A method of assessing the functioning of an EGR cooler of an EGR system in an internal combustion engine, wherein said EGR cooler can be selectively operated in a first and a second operating condition; wherein said engine comprises at least one cylinder equipped with a pressure sensor and a control unit configured to perform a cylinder-pressure based combustion control by which a combustion characteristic value depending on cylinder pressure is maintained at a given set point by adjusting a fuel injection parameter;

wherein the assessment of the functioning of said EGR cooler is based on the variation of said fuel injection parameter between the first and the second operating conditions of said EGR cooler.

12. The method according to claim 11, wherein the difference of said injection parameter between the first and the second condition is compared to a calibrated range or calibrated threshold.

13. The method according to claim 11, wherein said combustion characteristic value is indicative of the timing of a given percentage of heat release $CA_X$, net; and said fuel injection parameter is a main injection timing.

14. The method according to claim 13, wherein said combustion characteristic value is indicative of the timing of a percentage of heat release between 30% and 70%.

15. The method according to claim 11, wherein fuel injection parameter values in the first and second conditions are determined for substantially similar EGR rates and under substantially stable engine conditions.

16. The method according to claim 15, wherein said injection parameter values in the first and second conditions are determined for an EGR in the range of 30 to 50%.

17. The method according to claim 11, wherein said injection parameter values in the first and second conditions are determined at cold to moderate engine temperature.

18. The method according to claim 11, wherein one of said first and second operating conditions corresponds to the EGR cooler enabled and the other to the EGR cooler disabled.

19. The method of claim 1 wherein the step of indicating a fault condition comprises generating a signal operable to control an output device.

20. The method of claim 19 wherein the output device is a visual indicator or a memory storage device.

* * * * *